US005904783A

United States Patent [19]

Hager et al.

[11] Patent Number: 5,904,783

[45] Date of Patent: May 18, 1999

[54] METHOD FOR REDUCING LEAD LEACHING IN FIXTURES

[75] Inventors: John P. Hager, Golden; Jerome P. Downey, Parker, both of Colo.

[73] Assignee: Hazen Research, Inc., Golden, Colo.

[21] Appl. No.: 08/936,264

[22] Filed: Sep. 24, 1997

[51] Int. Cl.[6] ..... C22B 3/06

[52] U.S. Cl. ..... 148/242; 75/638; 75/710

[58] Field of Search ..... 75/743, 710; 148/553, 148/242

[56] References Cited

U.S. PATENT DOCUMENTS

| | | | |
|---|---|---|---|
| 4,879,094 | 11/1989 | Rushton . | |
| 5,137,685 | 8/1992 | McDivitt . | |
| 5,454,876 | 10/1995 | Downey . | |
| 5,544,859 | 8/1996 | Coltrinari et al. . | |
| 5,601,658 | 2/1997 | Marinas et al. | 148/553 |

OTHER PUBLICATIONS

Marinas et al., Control of Drinking–Water Lead–Contamination Contributed by Brass Plumbing Fixtures, *Proc. 1993 Am. Waterworks Assoc. Ann. Conf.*, pp. 945–971. No Month.

*Primary Examiner*—Prince Willis
*Assistant Examiner*—Tima M. McGuthry-Banks
*Attorney, Agent, or Firm*—Sheridan Ross P.C.

[57] ABSTRACT

A method for treating a brass fixture having a fluid-contacting surface with lead dispersoids exposed thereon to reduce lead leaching into a fluid supply by contacting the brass fixture with a liquid metal solution selected from the group consisting of a liquid sodium solution, a liquid potassium solution and a liquid metal alloy solution to dissolve lead dispersoids from the fixture, wherein the metal alloy comprises a metal selected from the group consisting of sodium and potassium.

23 Claims, 2 Drawing Sheets

PRIOR ART

METHOD FOR REDUCING LEAD LEACHING IN FIXTURES

FIELD OF THE INVENTION

The present invention relates to a method for removing lead from a brass fixture containing lead dispersoids.

BACKGROUND OF THE INVENTION

Potable water systems are comprised of numerous components including pipe and plumbing fixtures such as faucets, valves, couplings, and pumps which both store and transport water. These components have traditionally been made of copper-based cast and wrought alloys with lead dispersed therein in amounts between 1–9% by weight. The lead allows these components to be more easily machined into a final product which has both a predetermined shape yet acceptable strength and watertight properties.

The lead used to improve the machinability of these copper alloy materials has been proven to be harmful to humans when consumed as a result of the lead leaching into potable water. This damage is particularly pronounced in children with developing neural systems. To reduce the risk of exposure to lead, federal and state governments now regulate the lead content in potable water by requiring reductions in the amount of lead which can leach from plumbing fixtures. A variety of strategies have been developed to address this problem. For example, simply reducing the amount of lead in plumbing fixtures has been attempted. However, such low lead content alloys are difficult to machine.

Another strategy is to develop specific alloys such as that disclosed in U.S. Pat. No. 4,879,094 to Rushton. The patent describes an alloy which contains 1.5–7% bismuth, 5–15% zinc, about 1–12% tin and the balance copper. This copper alloy is capable of being machined, but must be cast and not wrought. This is undesirable since a wrought alloy may be extruded or otherwise mechanically formed into shape. It is thus not necessary to cast objects to a near finished shape. Further, wrought alloy feed stock is more amenable to high speed manufacturing techniques and generally has lower associated fabrication costs than cast alloys.

A copper based machinable alloy with a reduced lead content or which may be lead free was disclosed by McDivitt in U.S. Pat. No. 5,137,685. This alloy contains from about 30–58% by weight zinc, 0–5% weight of bismuth, and the balance of the alloy being copper. This alloy is expensive to produce, however, based both on the cost of the bismuth as compared to lead, and further since the bismuth must be thoroughly mixed within the matrix of the copper alloy material.

Another approach to inhibiting lead leaching in water involves non-continuous coating of lead dispersoids in the brass fixture as described by Coltrinari et al. in U.S. Pat. No. 5,544,859. The patent describes a method and apparatus for selectively coating lead dispersoids with, e.g., tin or bismuth, thereby reducing the amount of lead exposed to the liquid conduit. This coating results in lower lead leaching into the liquid.

Yet another approach involves treating brass plumbing components with an aqueous solution containing a desired concentration of chloride and pyrophosphate as described by Downey in U.S. Pat. No. 5,454,876. The patent discloses a method for promoting dissolution of lead by chlorine ion and sequestering the dissolved lead in the solution by pyrophosphate ion to prevent the lead dissolution reaction from reaching equilibrium. This process generates a waste solution which cannot be simply discarded but requires special disposal methods.

Therefore, despite the developments made in the area of reduced lead leaching into potable water systems, there remains a need to provide a material which is less susceptible to leaching lead into potable water systems, yet which utilizes the inherent benefits of copper alloys that contain lead, and for a process of removing lead from brass fixtures which does not generate wastes that require special disposal methods.

SUMMARY OF THE INVENTION

The present invention provides a method for treating a brass fixture having a fluid-contacting surface with lead dispersoids exposed thereon to reduce lead leaching into water supplies. The method comprises contacting the brass fixture with a liquid metal solution to dissolve at least a portion of the lead dispersoids, and removing the brass fixture from the solution. Typically, a liquid metal solution at a temperature from about 150° C. to about 250° C. is used to dissolve the lead dispersoids. The liquid metal solution includes sodium, potassium or metal alloys which include sodium and/or potassium.

The invention further provides contacting a brass fixture which has been immersed in the liquid metal bath with a neutralizing solution. Typically, any liquid metal solution material remaining on the brass fixture is quenched by immersing the brass fixture in a solution containing a mixture of alcohol and water.

The invention further provides a method of neutralizing the resulting alkaline solution of a metal alkoxide and/or metal hydroxide by quenching the basic solution with an acid. Preferably, hydrochloric acid is used to neutralize the alkaline solution. This quenching results in formation of harmless products composed of water and a metal chloride, for example, sodium chloride and/or potassium chloride.

The invention further provides a method of removing the lead dissolved in the liquid metal bath by lowering the temperature of the bath to about 110° C. which causes solid lead to precipitate out of the solution. This method provides a facile separation of lead from the liquid metal solution simply by removing the solid lead from the solution. Typically, the liquid metal solution used to dissolve the lead dispersoids is at temperatures from about 150° C. to about 250° C.

The present invention is applicable for removing lead from any brass item including, but not limited to a plumbing fixture or a device for fluid storage and transportation such as pipe, faucet, valve and pump.

DETAILED DESCRIPTION OF THE INVENTION

The present invention provides a method for removing lead from a fixture used in conducting the flow of fluids such as water, thus inhibiting the leaching of lead into the fluid. The invention is applicable to pipes, valves, faucets, pumps and other commonly known plumbing fixtures. The materials typically used in the production of these plumbing fixtures include copper alloys, such as brass, which have lead dispersed throughout the alloy material.

Figure 1:
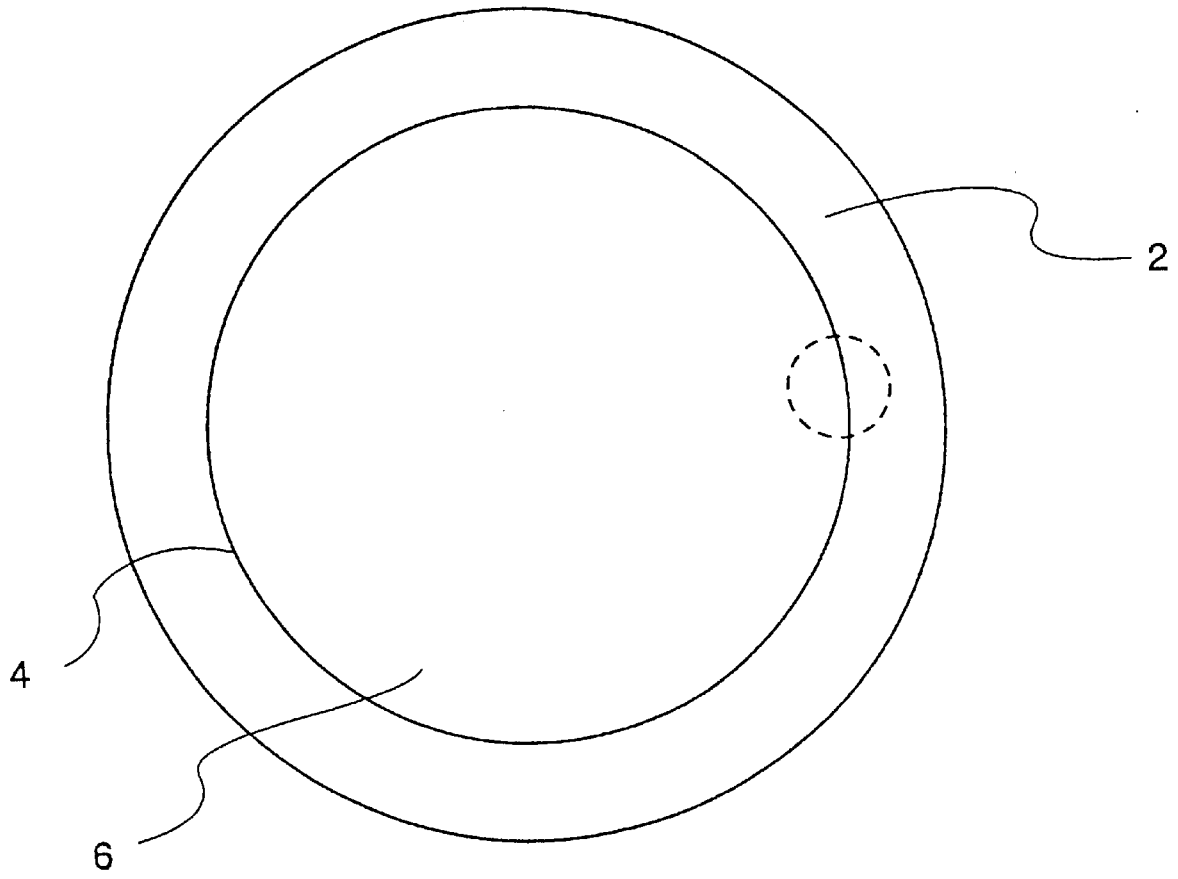
FIG. 1 depicts a cross-sectional view of a pipe or plumbing fixture capable of storing or transporting potable water or other fluids.
Figure 2:
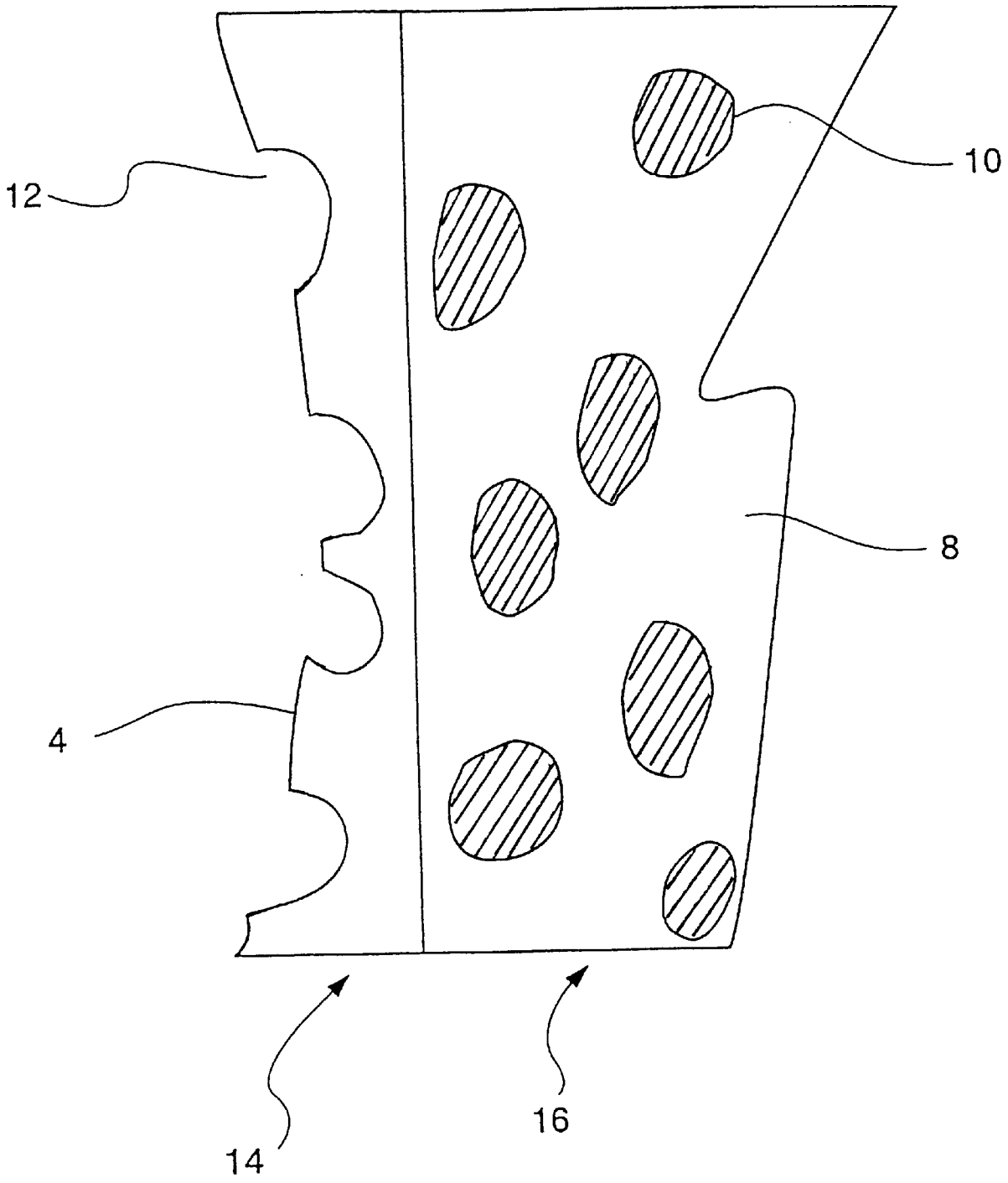
FIG. 2 is an expanded cross-sectional view depicting the conduit surface, perimeter portion, continuous solid phase, second solid phase, and voids.

As shown in FIGS. 1 and 2, a fixture produced by the process of the present invention includes a solid body piece 2 having voids 12. The flow directing or solid body piece 2 is shaped such that it has a conduit surface 4 which substantially defines a conduit volume 6. The conduit volume 6 is the space through which the apparatus is designed to have fluid flow. For example, in the instance where the apparatus is a pipe, the conduit surface 4 is the inside surface of the pipe, which contacts water flowing through the pipe on the fluid contact or conduit surface 4.

The solid body piece 2 includes a continuous solid phase 8 and a second solid phase 10 within the continuous solid phase 8. For instance, in the case of a brass pipe having lead dispersoids throughout the brass, the brass is the continuous solid phase 8 and the lead constitutes the second solid phase of dispersoids 10.

The continuous solid phase 8 is typically metal and more typically comprises copper. For example, the continuous solid phase 8 can be a copper alloy and can contain over 50% by weight of copper. Such copper alloys can be brass including Cu/Zn/Si; Mn bronze; leaded Mn bronze and a variety of bronzes including Cu/Sn; Cu/Sn/Pb; Cu/Sn/Ni; Cu/Al; and other high copper alloys containing 94–98.5 weight percent Cu and 0.02 weight percent lead. The alloys typically include between about 50 weight percent and about 98.5 weight percent Cu, more preferably between about 53.5 weight percent and about 94 weight percent Cu and more preferably between about 60 weight percent and about 82 weight percent Cu. In a preferred embodiment of the present invention, a continuous solid body phase comprised of about 57%–82% copper, 0.2% tin, 7%–41% zinc, 2%–8% lead, and trace amounts of iron, antimony, nickel, sulfur, phosphorous, aluminum and silicon is used.

The second solid phase of dispersoids 10 comprise lead. The lead dispersoids are dispersed in the continuous solid phase 8 and a plurality are adjacent the fluid contact or conduit surface 4. Thus, while the lead dispersoids are contained throughout the interior matrix of the continuous solid phase 8, some portion can be exposed on the fluid contact or conduit surface 4. Therefore, untreated solid body pieces 2 having lead exposed to fluids flowing throughout the conduit volume 6 allow for the leaching of lead into the fluid, which may contaminate the fluid. Typically, lead dispersoids approximately comprise 1–9% by weight of the solid body piece 2 and more typically 3–5%. In one embodiment, the second solid phase of dispersoids 10 consists essentially of lead. The plurality of lead dispersoids allows the solid body piece 2 to be machined more easily and allows for the use of wrought alloy feed stock rather than cast alloy components.

In accordance with the method of the present invention, as described fully below, a treated apparatus also includes multiple voids 12 at the conduit surface 4. The voids 12 are formed by removal of lead dispersoids occurring at the conduit surface 4 by the present process.

In another embodiment of the apparatus produced by the method of the present invention, the solid body piece 2 comprises a perimeter portion 14 which includes the conduit surface 4 and an interior portion 16 which is integral with the perimeter portion 14. The interior portion 16 does not include the conduit surface 4. Dispersoids in the interior portion 16 of the solid body piece 2 are not subject to the present process. Because the liquid metal solution is applied to the surface of the solid body piece 2 or only to the conduit surface 4 of the solid body piece 2 voids do not occur uniformly throughout the solid body piece 2. As used in this invention, "liquid metal solution" refers to a metal or an alloy in a liquid state and includes a pure liquid metal as well as liquid metal containing impurities.

In one embodiment of the present invention, the brass fixture having a fluid-contacting surface with lead dispersoids exposed thereon is contacted with liquid metal solution to dissolve at least a portion of the lead dispersoids. The resulting brass fixture has a lower capacity for lead leaching into fluids, such as water, carried thereby than does on an untreated fixture. Preferably the liquid metal bath (i.e., solution) removes at least about 50% by weight of the surface lead dispersoids, more preferably at least about 75% by weight, and most preferably at least about 90% by weight. In another aspect of the present invention, the surface area of the second solid phase of lead dispersoids exposed on the conduit surface 4 is removed by at least about 90% by the method of the present invention. In a more preferred embodiment, the surface area of the second solid phase of lead dispersoids 10 exposed on the conduit surface 4 is reduced by at least about 95% and in a most preferred embodiment, at least about 99%.

Any liquid metal or alloy which has a relatively low melting point and selectivity to dissolve significantly more lead in the presence of copper can be used in the present invention as an immersion bath for removing lead from a brass fixture. A useful immersion bath include, but are not limited to, a liquid sodium, a liquid potassium and a liquid alloy containing sodium and/or potassium.

Liquid sodium has been used in variety of areas, including passivating the surface of polytetrafluoroethylene (Teflon) for the acceptance of adhesives. See page 6 of a product pamphlet published by Du Pont entitled "Sodium Properties, Uses Storage, and Handling." Sodium metal melts at about 97.8° C. At this temperature, only a trace amount of lead dissolves in liquid sodium. As the temperature is gradually increased, solubility of lead in liquid sodium increases. At around 200° C., up to about 20% by weight of lead may be dissolved in liquid sodium. With increases in temperature, however, the solubility of other metals also increases correspondingly. Thus, a temperature of liquid sodium preferred for selective removal of lead from a brass fixture is greater than about 110° C., more preferably greater than about 150° C., and most preferably greater than about 200° C. A preferred range of liquid sodium temperature is between about 110° C. and about 275° C., more preferably between about 150° C. and about 250° C., and most preferably between about 175° C. and about 225° C.

Liquid potassium metal melts at about 63.5° C. Even at this temperature, about 10% by weight of lead dissolves in liquid potassium. As the temperature is gradually increased, solubility of lead in liquid sodium increases. At around 200° C., up to about 30% by weight of lead may be dissolved in liquid potassium. With increases in temperature, however, the solubility of other metals also increases correspondingly. Thus, a temperature of liquid potassium preferred for selective removal of lead from a brass fixture is greater than about 80° C., more preferably greater than about 150° C., and most preferably greater than about 200° C. A preferred range of liquid potassium temperature is between about 100° C. and about 275° C., more preferably between about 150° C. and about 250° C., and most preferably between about 175° C. and about 225° C.

A metal alloy comprising potassium and sodium have much lower melting point than either of the pure metals. For example, at the eutectic point (76.7% by weight of potassium) the metal alloy melts at about −12.5° C. Therefore, if a lower temperature is desired for the removal of lead dispersoids in a brass fixture, one skilled in the art can easily determine the desired potassium-sodium composition for a particular temperature range desired.

It is preferred that the temperature of liquid metal, and other process conditions, provide for dissolution of a high amount of lead while maintaining dissolution of a low amount of other metals such as copper and zinc which are also present in a brass fixture so that lead is selectively removed. Preferably, the step of contacting a brass fixture with the liquid sodium bath is conducted under conditions such that the individual concentration of other metals from the brass fixture, such as copper and zinc, is maintained at a concentration in the liquid metal bath below about 10% by weight, more preferably below about 5% by weight, and most preferably below about 2.5% by weight.

In another embodiment of the present invention, the brass fixture having a fluid-contacting surface with lead dispersoids exposed thereon is contacted with a liquid metal solution for a time adequate to substantially remove lead from the brass fixture. Preferably the brass fixture is contacted with a liquid metal solution for at least about 5 minutes, more preferably for at least about 15 minutes, and most preferably for at least about 30 minutes.

In another embodiment of the present invention, the brass fixture having a fluid-contacting surface with lead dispersoids exposed thereon is contacted with a sufficient volume of the liquid metal solution to substantially remove surface lead dispersoids from the brass fixture under a given time and temperature of the liquid metal solution. Preferably, the volume of the liquid metal solution is sufficient to completely immerse a portion of the brass fixture to be treated by the present invention. More preferably, the volume of the liquid metal is sufficiently large enough to treat many fixtures in the bath, preferably in continuous mode. In some cases, it may be necessary or even desirable to frequently purify the liquid metal bath to help ensure that the solubility limit for lead is not exceeded. The exact amount of liquid metal solution required depends on many factors such as immersion bath operating temperature, the solubility of lead in a given liquid metal solution, the amount of lead in the untreated brass fixtures, and the number of brass fixtures treated per unit of time.

The present invention can be used to remove substantially all surface lead dispersoids or substantially only those surface lead dispersoids on the conduit surface which the apparatus is designed to have fluid flow. For example, a complete immersion of the brass fixture in a liquid metal solution provides substantial removal of all surface lead dispersoids, whereas contacting only the conduit surface of the brass fixture with a liquid metal solution results in substantial removal of lead dispersoids only on the conduit surface of the brass fixture. Selective lead removal from the conduit surface can be achieved by pouring the liquid metal solution into the conduit of the brass fixture or allowing a continuous flow of a liquid metal solution through the conduit of the brass fixture.

In another embodiment of the present invention, an effective amount of lead is removed from the brass fixture having a fluid-contacting surface with lead dispersoids exposed thereon by contacting the brass fixture with a liquid metal solution to provide a brass fixture having an amount of lead acceptable for health reasons to provide safe drinking supplies and/or to meet applicable federal or state governmental regulations.

The effectiveness of the present invention can be quantitatively measured in various ways. For example, the percent removal of lead dispersoids exposed on the surface of a fluid conduit can be measured, for example by electron microscopic techniques, or ZAF-corrected analysis. As used in this invention, a "ZAF-corrected analysis" refers to a semi-quantitative analysis obtained via electron microscopic technique which accounts for the atomic number (Z), atomic weight (A) and fluorescence (F) effects of the element being analyzed. The technique is well-known by one skilled in the art of electron microscopy. In addition, the effectiveness of the present invention in reduction of lead leaching into water can be quantitatively measured by tests which measure the amount of lead in water which has been allowed to stand in contact with a fixture under standardized conditions. For example, one standardized procedure has been established by the National Sanitation Foundation and is known as the National Sanitation Foundation 61 ("NSF-61") procedures. More specifically, Section 9 of the NSF-61 publication discusses the procedure for testing mechanical plumbing devices and components.

The NSF-61 standardized procedure requires the triplicate testing of mechanical plumbing fixtures, wherein samples are rinsed with tap water at room temperatures, then filled with water at various temperatures for periods of time up to 90 days. The contaminant level of lead which has leached into the water from the fixture is then quantitatively measured to gauge the lead leaching characteristics of the particular plumbing apparatus or fixture. This procedure is discussed in detail by Coltrinari et al., in U.S. Pat. No. 5,544,859, which is incorporated herein in its entirety.

Untreated wrought brass alloys normally obtain a NSF-61 score of about 10 micrograms/liter when the alloy is exposed to water for a period of 1 day. Thereafter, the concentrations of lead falls within the range of 3–6 micrograms/liter during subsequent days of testing. Similarly, typical NSF-61 scores for untreated cast brass ranges from about 50–55 micrograms/liter after exposure to water for 1 day, declining to about 38 micrograms/liter on day 2, and ranging from about 13–25 micrograms/liter for subsequent days of testing.

A further embodiment of the present invention includes recovering lead from the liquid metal solution by lowering the temperature of the liquid metal bath to decrease the solubility of lead in the liquid metal solution, preferably to a temperature of less than about 110° C., and more preferably less than about 80° C. One of the advantages of a temperature dependant solubility of lead in a liquid metal solution is the ease of purification of the resulting liquid metal solution. Lowering the temperature of liquid metal solution containing dissolved lead to about 110° C. results in precipitation of solid lead which can be easily separated from the liquid metal solution by any of the standard techniques known in separating a solid from a liquid, such as filtration, sedimentation/decantation and centrifuging.

In a further embodiment, this "purified", i.e., separated, liquid metal solution can be recycled and used again to dissolve lead from another brass fixture by reheating the liquid metal solution and contacting it with a brass fixture.

A further embodiment of removing lead from a brass fixture having a fluid-contacting surface with lead dispersoids exposed thereon by contacting with a liquid metal solution is neutralization of liquid metal solution material present in the brass fixture after it has been removed from the liquid metal solution. As used in this invention, "liquid metal solution material" refers to the metal or alloy which is used as the liquid metal solution to dissolve lead. Depending on the temperature, the liquid metal solution material, which is present in the brass fixture after it has been removed from the liquid metal solution, can be a liquid or a solid. It is preferred that after contacting the brass fixture with a liquid metal solution to dissolve lead dispersoids as generally described herein, the brass fixture is removed from the liquid metal solution and any liquid metal solution material remaining on the brass fixture is neutralized with a neutralizing solution. Preferably, the neutralizing solution comprises a solvent having a proton source, more preferably the solvent comprises a mixture of alcohol and water. Alcohols which are useful in neutralizing solid or liquid sodium include, but are not limited to, methanol, ethanol, propanol, i-propanol, n-butanol, i-butanol, t-butanol, pentanol, hexanol, heptanol, and octanol.

When liquid metal solution material is treated with alcohol and/or water, a metal alkoxide and/or a metal hydroxide is formed, respectively, as a reaction product. This basic metal salt can be neutralized with an acid such as hydrochloric acid, sulfuric acid, phosphoric acid, hydriodic acid, hydrobromic acid or a carboxylic acid, such as acetic acid. Preferably, hydrochloric acid is used to neutralize the resulting metal alkoxide and/or metal hydroxide. The use of hydrochloric acid results in formation of water and metal chloride, e.g., sodium chloride and/or potassium chloride, as the reaction products which are environmentally safe and can be readily disposed of without any need for a special treatment.

The present method of lead removal is applicable to variety of plumbing fixtures or devices for fluid storage and transportation including, but not limited to, pipes, faucets, valves, and pumps.

The following examples are provided for the purposes of illustration and are not intended to limit the scope of the present invention.

EXAMPLES

Standard Procedure

A standard experimental procedure for treating brass materials in accordance with the present invention is provided below.

Solid sodium metal is added to a melting furnace ("chamber") to produce a liquid sodium bath depth sufficient to immerse brass coupons to simulate a sample of a brass fixture. The size of the bath container is selected to provide sufficient freeboard to preclude a possibility of a sodium spill. After the test coupons are positioned in the chamber, the chamber access door is closed and sealed. The chamber is flushed with nitrogen, and an inert atmosphere of nitrogen is maintained throughout the experiment. It should be cautioned that sodium metal reacts violently with any moisture in atmosphere and ignites in air at about 120° C.

The sodium bath temperature is gradually increased to a desired target temperature. Once the liquid sodium bath is stabilized to a desired temperature, the first coupon is immersed in the bath for the prescribed period of time. After the immersion for a desired period of time, the coupon is removed and held just above the bath to allow excess sodium to drip off before proceeding with the next coupon in the series. After the last coupon in the series is treated, the bath temperature is lowered to about 110° C. The chamber is opened for recovery of the treated coupons. The treated coupons are removed from the chamber and residual sodium is washed off the treated coupons by immersing them in a 4:1 mixture of propanol and water. Each treated coupon is tagged with a label detailing the test conditions and stored in a container pending scanning electron microscopic examination. Precautions are taken to avoid accidental contamination of the treated coupons. At the conclusion of the tests, the liquid sodium is drained from the melting furnace into a prepositioned graphite mold and allowed to solidify. The melting pot and chamber are cleaned with the propanol and water mixture.

It should be noted that after melting, the liquid sodium typically has a relatively thin, white to blue-white, oxide layer on its surface. When the first coupon is inserted into a fresh melt, the oxide layer around the coupon obtains a brass coloration. Generally, the treated coupons retain a thin layer of oxide and/or metallic sodium prior to immersion in alcohol water mixture. Caution should be exercised when immersing the treated coupon into an alcohol water mixture as a violent reaction may occur.

The procedure's effectiveness is determined by electron microprobe evaluation. A scanning electron microprobe (SEM) is used to produce backscattered electron images (BEI) of the surfaces of the as-received and treated samples. Also, some samples were analyzed by ZAF-corrected analysis (ZAF).

Example 1

This Example illustrates the effect of the present invention on wrought and cast brass at various immersion times.

Brass coupons were partially immersed in a liquid sodium solution in accordance with the standard procedure described above. The temperature of the liquid sodium bath was 200° C. Tests were conducted with wrought and cast alloy types with immersion times of 5, 15, 30, 60 and 120 minutes. The results are shown below in Table 1.

TABLE 1

Results of Different Alloy Brass Coupon Immersions in a 200° C. Liquid Sodium Solution at Different Time Intervals

| Alloy Type | Immersion Time (min) | Comments |
|---|---|---|
| cast | untreated | BEI-Significant amount of lead was present. |
| cast | 5 | BEI-Lead removal was efficient for lead dispersoids but not for "smeared" lead. |
| cast | 15 | BEI-Surface lead depleted in the area that was immersed in the liquid sodium solution. |
| cast | 30 | BEI-A zone of residual surface lead remained, but otherwise lead removal efficiency was high. |
| cast | 60 | BEI-Surface lead depleted in the area that was in contact with the liquid sodium solution. |
| cast | 120 | BEI-Liquid sodium solution treated portion of the brass coupon had significantly less amount of surface lead than untreated portion of the brass coupon. |
| wrought | 60 | BEI-Substantial elimination of lead on flat surface of a wrought coupon. |

In general, immersion of the samples in liquid sodium effectively removed the surface inclusions of lead. Many of the backscattered electron images illustrated a clear transition evident between the portion of each sample that was immersed in the liquid sodium and that which was not.

Example 2

This Example illustrates the effect of the practice of the present invention on brass having different surface irregularities.

Four types of brass specimen coupons were treated in accordance with the Standard Procedure described above: cast (CDA 84400), wrought (CDA 36000), polished wrought brass (CDA 36000) as control samples, and a section of a test cylinder (CDA 36000). The above designations refer to the Copper Development Association (CDA) numbers for the two brass types that were used in the present testing. The polished control samples were tested to provide a basis for comparison in determining the effect of the surface irregularities common to the other types of sample. It should be also noted that wrought brass samples were generally much smoother than the cast brass samples.

One specimen from each of the four coupon types was immersed for 30 minutes in a 200° C. liquid sodium. A five-minute immersion test was also conducted on a duplicate of the polished control sample. The results are shown below in Table 2.

TABLE 2

Effect of Relative Surface Roughness of Brass in Removal of Lead by a Liquid Sodium Solution at 200° C.

| Alloy Type | Immersion Time (min) | Comments |
|---|---|---|
| untreated control wrought brass CDA 36000 | N/A | BEI-Significant amount of lead was present. |
| polished wrought brass CDA 36000 | 30 | BEI-The surface of the specimen was devoid of lead. ZAF-No lead detected. |
| polished wrought brass CDA 36000 | 5 | BEI-Sample was devoid of lead. ZAF-0.7% lead present. |
| wrought brass CDA 36000 | 30 | BEI-No surface lead was evident. ZAF-0.6% lead present. |
| cast brass CDA 84400 | 30 | BEI-Significant amount of lead was present. ZAF-5.9% lead present. |

Metallographic techniques and electron microprobe evaluation were used to evaluate each treated specimen. The back scattered electron images of the specimens revealed very little lead remained on the surface after treatment. The ZAF-corrected analysis of the specimens confirmed this fact.

The results of this example indicate that the treatment method appears to be influenced by the surface morphology of a particular sample, e.g., the more even the surface, the more effective the lead removal. The best result was obtained with the control specimen with the polished surface. No lead could be detected in the backscattered electron image of the polished control coupon that was immersed for 30 minutes, and the ZAF-corrected analysis showed no lead was present. Based on visual evidence, the control coupon that was immersed for only 5 minutes also resulted in nearly total lead removal, as no lead was evident in the backscattered electron images. However, the ZAF-corrected analysis for this specimen indicated presence of 0.7% lead. The difference in immersion time could conceivably account for the slight amount of lead detected in the five-minute specimen. Similarly, no surface lead was evident in the wrought coupon, but the ZAF-corrected analysis indicated presence of 0.6% lead.

The technique was not as effective with the cast coupon. Several lead inclusions were visible on the photograph of the backscattered electron image of the treated specimen. The ZAF-corrected analysis indicated presence of 5.9% lead. The difference in response to the experiment may possibly be a result of much rougher surface of the casting.

Example 3

This Example illustrates the practice of the present invention at different liquid sodium solution temperatures.

At 300° C., lead can be dissolved in liquid sodium to form a liquid alloy containing approximately 40% lead by weight, or about double the amount compared to liquid sodium at 200° C.

Four types of brass coupons were treated in accordance with the Standard Procedure described above: the cast and wrought coupons, flat (unpolished) control coupons, and cylinder segments. Samples of each brass coupon type were immersed in liquid sodium at 300° C. for 5 or 15 minutes.

A significant discoloration was observed on the treated samples following the immersion tests at 300° C.; each sample had a very dark blue-grey tint after the treatment. The discoloration was most obvious on the wrought coupon and test cylinder sections.

Electron microprobe evaluation and ZAF-corrected analysis suggested that the other metals, such as copper and zinc, were also being dissolved in significant amounts at 300° C. Consequently, substantial surface lead remained exposed in the treated specimens. According to the ZAF-corrected analysis, the lead content of all specimens treated at 300° C. was 2.8% or higher.

Those skilled in the art will appreciate that numerous changes and modifications may be made to the preferred embodiments of the present invention and that such changes and modifications may be made without departing from the spirit of the invention. It is therefore intended that the appended claims cover all such equivalent variations as fall within the true spirit and scope of the invention.

What is claimed is:

1. A method for treating a brass fixture having a fluid-contacting surface with lead dispersoids exposed thereon to reduce lead leaching into a fluid supply, said method comprising:

(a) contacting said brass fixture with a solution to dissolve at least a portion of said lead dispersoids, wherein said solution comprises a metal in the liquid state, and wherein said metal is selected from the group consisting of sodium, potassium, and mixtures thereof; and (b) removing said brass fixture from said solution.

2. The method of claim 1, wherein the temperature of said solution during said step of contacting is between about 150° C. and about 250° C.

3. The method of claim 1, wherein the temperature of said solution is greater than about 200° C.

4. The method of claim 1, further comprising the step of recovering lead from said solution.

5. The method of claim 4, wherein said step of recovering lead from said solution comprises lowering the temperature of said solution to less than about 110° C.

6. The method of claim 4, wherein said recovery of said lead comprises precipitating said lead from said solution.

7. The method of claim 6, further comprising separating said precipitated lead from said solution and contacting said separated solution with a brass fixture to dissolve at least a portion of said lead dispersoids therein.

8. The method of claim 1, wherein said liquid metal solution has a copper concentration of less than about 2.5% by weight.

9. The method of claim 1, wherein said liquid metal solution has a zinc concentration of less than about 2.5% by weight.

10. The method of claim 1, further comprising removing solution material from said brass fixture by contacting said brass fixture containing said solution material with a neutralizing solution.

11. The method of claim 10 wherein said neutralizing solution comprises a solvent having a proton source.

12. The method of claim 11 wherein said solvent comprises a mixture of an alcohol and water, and wherein said step of contacting said brass fixture with said neutralizing solution produces a metal hydroxide and/or a metal alkoxide.

13. The method of claim 12, wherein said metal hydroxide and/or metal alkoxide is reacted with an acid to form said alcohol and/or water and a metal salt.

14. The method of claim 13 wherein said acid is hydrochloric acid.

15. The method of claim 1, wherein said brass fixture comprises a brass fixture selected from the group consisting of a plumbing fixture, a piping piece, a faucet, a valve and a pump.

16. The method of claim 1, wherein said solution comprises liquid sodium.

17. The method of claim 1, wherein said solution comprises liquid potassium.

18. A method for treating a brass fixture having a fluid-contacting surface with lead dispersoids exposed thereon to reduce lead leaching into a fluid supply, said method comprising:

(a) contacting said brass fixture with a solution at a temperature between about 150° C. and about 250° C. to dissolve at least a portion of said lead dispersoids, wherein said solution comprises a metal in the liquid state, and wherein said metal is selected from the group consisting of sodium, potassium, and mixtures thereof;

(b) removing said brass fixture from said solution; and (c) recovering lead from said solution by lowering the temperature of said solution to less than about 110° C.

19. The method of claim 18, wherein said liquid metal solution has a copper concentration of less than about 2.5% by weight.

20. The method of claim 18, further comprising removing solution material from said brass fixture by contacting said brass fixture containing said solution material with a neutralizing solution.

21. A method for treating a brass fixture having a fluid-contacting surface with lead dispersoids exposed thereon to reduce lead leaching into a fluid supply, said method comprising:

(a) contacting said brass fixture with a solution at a temperature between about 150° C. and about 250° C. to dissolve at least a portion of said lead dispersoids, wherein said solution comprises a metal in the liquid state, and wherein said metal is selected from the group consisting of sodium, potassium, and mixtures thereof;

(b) removing said brass fixture from said solution; and (c) removing solution material from said brass fixture by contacting said brass fixture with a neutralizing solution.

22. The method of claim 21, wherein said neutralizing solution comprises a mixture of an alcohol and water.

23. A method for treating a brass fixture having a fluid-contacting surface with lead dispersoids exposed thereon to reduce lead leaching into a fluid supply, said method comprising:

(a) contacting said brass fixture with a liquid sodium solution at a temperature between about 150° C. and about 250° C. to dissolve at least a portion of said lead dispersoids;

(b) removing said brass fixture from said liquid sodium solution; and (c) removing sodium from said brass fixture by contacting said brass fixture with a solution comprising an alcohol and water.

* * * * *